US011051668B2

(12) United States Patent
Thorne et al.

(10) Patent No.: US 11,051,668 B2
(45) Date of Patent: Jul. 6, 2021

(54) VACUUM CLEANER HAVING RECONFIGURABLE WEIGHT DISTRIBUTION

(71) Applicant: SharkNinja Operating, LLC, Needham, MA (US)

(72) Inventors: Jason B. Thorne, Dover, MA (US); Kai Xu, Suzhou (CN); Sam Liu, Suzhou (CN); Adam Udy, Sutton (GB); Daniel J. Innes, West Roxbury, MA (US); Nikola Petrov, Needham, MA (US); Andre D. Brown, Natick, MA (US)

(73) Assignee: SharkNinja Operating LLC, Needham, MA (US)

( * ) Notice: Subject to any disclaimer, the term of this patent is extended or adjusted under 35 U.S.C. 154(b) by 222 days.

(21) Appl. No.: 16/422,521

(22) Filed: May 24, 2019

(65) Prior Publication Data

US 2019/0357740 A1 Nov. 28, 2019

Related U.S. Application Data

(60) Provisional application No. 62/676,640, filed on May 25, 2018.

(51) Int. Cl.
*A47L 5/22* (2006.01)
*A47L 9/24* (2006.01)
(Continued)

(52) U.S. Cl.
CPC ..... *A47L 5/225* (2013.01); *A47L 9/02* (2013.01); *A47L 9/102* (2013.01); *A47L 9/242* (2013.01); *A47L 9/2884* (2013.01)

(58) Field of Classification Search
CPC ... A47L 5/225; A47L 5/24; A47L 5/28; A47L 9/02; A47L 9/102; A47L 9/242; A47L 9/28; A47L 9/2884
See application file for complete search history.

(56) References Cited

U.S. PATENT DOCUMENTS

2002/0104184 A1* 8/2002 Rogers ..... A47L 9/244 15/327.5
2009/0188997 A1* 7/2009 Rosenzweig ..... A47L 9/242 239/722

(Continued)

FOREIGN PATENT DOCUMENTS

WO 2018128371 A1 12/2018

OTHER PUBLICATIONS

PCT Search Report dated Aug. 26, 2019, received in corresponding PCT Application No. PCT/US19/34002, 8 pgs.

*Primary Examiner* — Marc Carlson
(74) *Attorney, Agent, or Firm* — Grossman Tucker Perreault & Pfleger, PLLC

(57) ABSTRACT

A vacuum assembly having a hand vacuum configuration and a wand vacuum configuration may include a dust cup, a suction motor fluidly coupled to the dust cup, and a power source. The suction motor and the power source may be transitionable between a wand vacuum position and a hand vacuum position. When the suction motor and the power source are in the wand vacuum position, the dust cup, the suction motor, and the power source may be arranged serially. When the suction motor and the power source are in the hand vacuum position, the suction motor and the power source may be arranged in parallel with the dust cup.

18 Claims, 11 Drawing Sheets

(51) Int. Cl.

| | |
|---|---|
| ***A47L 9/28*** | (2006.01) |
| ***A47L 9/10*** | (2006.01) |
| ***A47L 9/02*** | (2006.01) |

(56) References Cited

U.S. PATENT DOCUMENTS

| | | | | |
|---|---|---|---|---|
| 2011/0219571 | A1* | 9/2011 | Dyson | A47L 9/2873 15/344 |
| 2013/0205538 | A1* | 8/2013 | Thompson | A47L 9/2857 15/344 |
| 2017/0112343 | A1* | 4/2017 | Innes | A47L 9/24 |
| 2017/0258282 | A1* | 9/2017 | Shinagawa | A47L 9/2857 |
| 2018/0000303 | A1* | 1/2018 | Conrad | A47L 9/1683 |
| 2018/0035854 | A1* | 2/2018 | Thorne | A47L 5/225 |
| 2019/0343356 | A1* | 11/2019 | Kim | A47L 9/2884 |
| 2020/0138254 | A1* | 5/2020 | Lee | A47L 9/32 |

* cited by examiner

VACUUM CLEANER HAVING RECONFIGURABLE WEIGHT DISTRIBUTION

CROSS-REFERENCE TO RELATED APPLICATIONS

The present application claims the benefit of U.S. Provisional Application Ser. No. 62/676,640 filed on May 25, 2018, entitled Vacuum Cleaner having Reconfigurable Weight Distribution, which is fully incorporated herein by reference.

TECHNICAL FIELD

The present disclosure is generally directed to surface treatment apparatuses and more specifically to vacuum cleaners having a reconfigurable weight distribution.

BACKGROUND INFORMATION

Surface treatment apparatuses may include wand (or stick) vacuum cleaners and hand (or handheld) vacuum cleaners. A wand vacuum cleaner may include a wand and may be configured to fluidly couple to, for example, a surface cleaning head having one or more agitators (e.g., brush rolls). A hand vacuum cleaner may be configured to be a handheld vacuum cleaner having an airflow path that extends into a dirty air inlet of the handheld vacuum cleaner. In some instances, the handheld vacuum may be configured to couple to one or more accessories (e.g., a crevice tool or a wand).

BRIEF DESCRIPTION OF THE DRAWINGS

These and other features and advantages will be better understood by reading the following detailed description, taken together with the drawings, wherein.

DETAILED DESCRIPTION

The present disclosure is generally directed to a surface treatment apparatus that is reconfigurable between a wand (or stick) vacuum mode and a hand (or handheld) vacuum mode. When reconfiguring the surface treatment apparatus between the wand vacuum mode and the hand vacuum mode, a location of a center of gravity of the surface treatment apparatus may be adjusted. For example, when the surface treatment apparatus is transitioned to the hand vacuum mode, the center of gravity may shift in a direction towards a handle of the surface treatment apparatus. By way of further example, when the surface treatment apparatus is transitioned to the wand vacuum mode, the center of gravity may shift in a direction away from the handle. By changing the location of the center of gravity the forces exerted on an operator of the surface treatment apparatus may be adjusted based on which mode the surface treatment apparatus is operating in.

In some embodiments, a surface treatment apparatus can include a vacuum assembly having a suction motor, a power source, a dust cup, and a handle. The suction motor and the power source can be configured to pivot relative to the dust cup such that the suction motor and power source transition between a wand vacuum position and a hand vacuum position. When the suction motor and power source are in the wand vacuum position, the suction motor, power source, and dust cup are arranged serially along a first axis. When the suction motor and power source are in the hand vacuum position, the suction motor and power source are arranged along a second axis that is spaced apart from the first axis. The second axis may extend generally parallel to the first axis. As such, when the suction motor and the power source are in the hand vacuum position, the suction motor and power source are positioned proximate the handle. As a result, a center of gravity of the vacuum assembly shifts towards the handle in response to the suction motor and power source being transitioned to the hand vacuum position. Therefore, a center of gravity of the surface treatment apparatus is positioned closer to the handle. Such a configuration, may allow an operator of the surface treatment apparatus to more easily reach locations above a floor (e.g., by reducing the forces exerted on a wrist of the operator).

Figure 2:
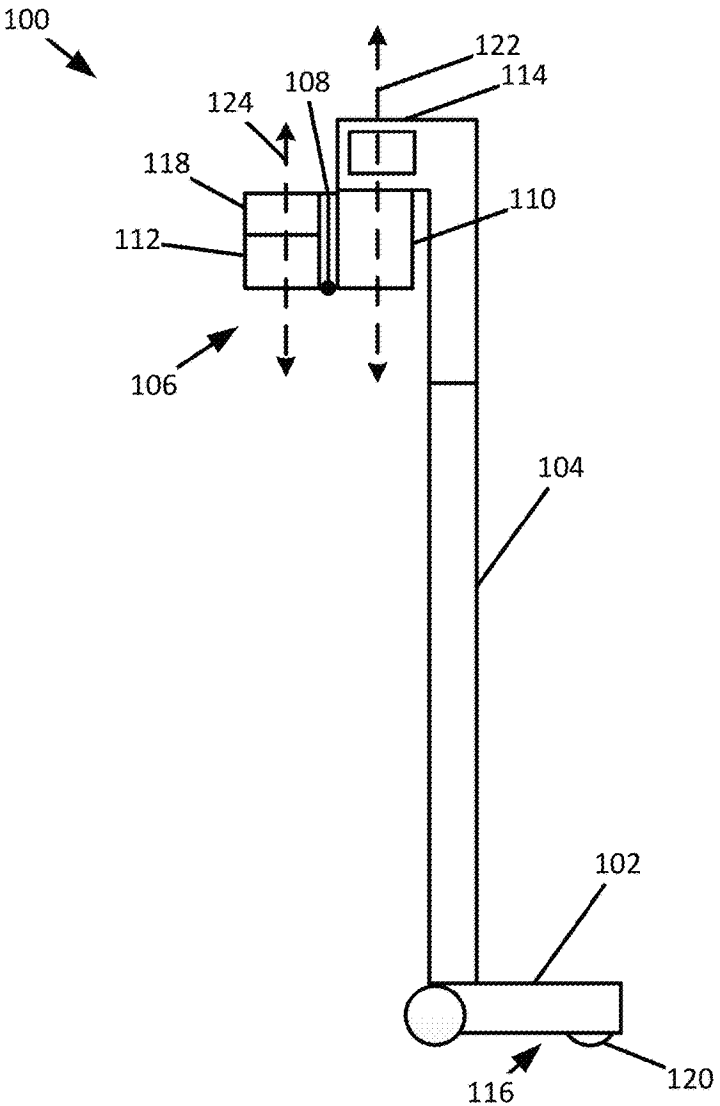
FIG. 2 is another schematic side view of the surface treatment apparatus of FIG. 1, wherein suction motor and the power source of the vacuum assembly are in a hand vacuum position, consistent with embodiments of the present disclosure.
Figure 1:
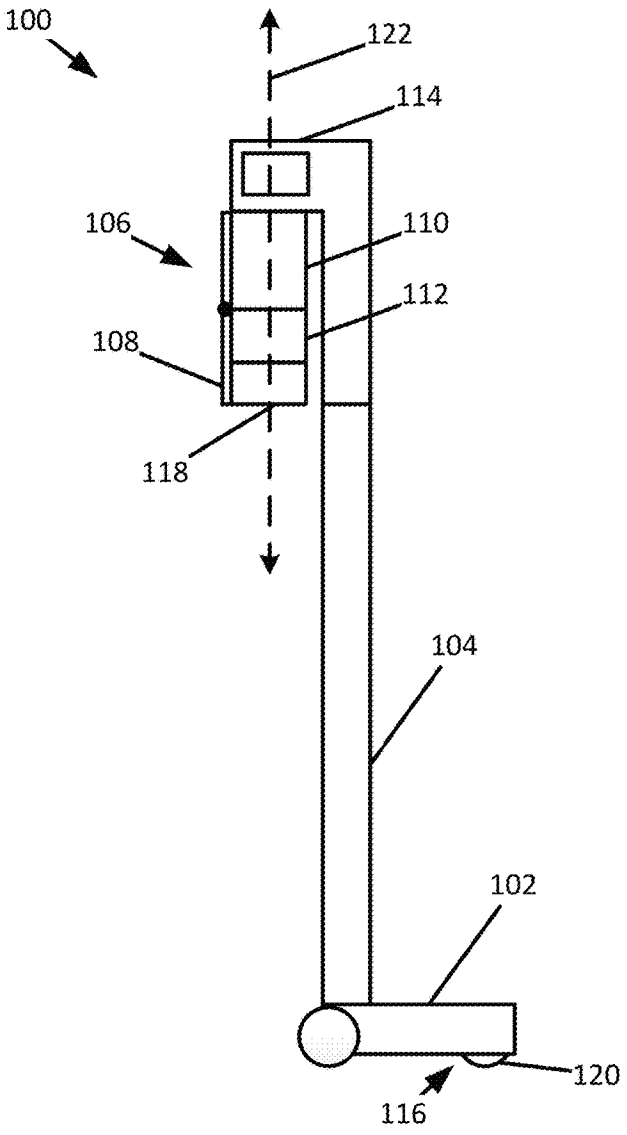
FIG. 1 is a schematic side view of a surface treatment apparatus having a vacuum assembly, wherein a suction motor and a power source of the vacuum assembly are in a wand vacuum position, consistent with embodiments of the present disclosure.

FIGS. 1 and 2 shows a schematic example of a surface treatment apparatus 100. As shown, the surface treatment apparatus 100 includes a surface treatment head 102, a wand 104 coupled to and extending from the surface treatment head 102, and a vacuum assembly 106 coupled to the wand 104 such that the vacuum assembly 106 is fluidly coupled to the surface treatment head 102. The vacuum assembly 106 is configured to be transitioned between a wand vacuum configuration (e.g., as shown in FIG. 1) and a hand vacuum configuration (e.g., as shown in FIG. 2).

The vacuum assembly 106 can be decoupled from the wand 104 such that, for example, the surface treatment apparatus 100 can be used in a hand vacuum mode. When decoupled from the wand 104, the vacuum assembly 106 can be configured to couple to one or more accessories. For example, the vacuum assembly 106 can be configured to be coupled to a crevice tool. In some instances, one or more accessories may be coupled to the wand 104 such that the vacuum assembly 106 can be coupled to one of the one or more accessories without an operator having to physically touch the corresponding accessory.

The vacuum assembly 106 includes a body 108, a dust cup 110, a suction motor 112, and a handle 114. The suction motor 112 is configured to generate a suction force that draws air in through a dirty air inlet 116 of the surface treatment head 102, through the wand 104, into the dust cup 110 and through the suction motor 112. In some instances, the vacuum assembly 106 can include a power source 118 coupled to the body 108 (e.g., one or more batteries) and configured to provide power to, for example, the suction motor 112 and/or one or more agitators 120 in the surface treatment head 102.

One or more of the dust cup 110, the suction motor 112, and/or the power source 118 can be coupled to the body 108. As shown, the suction motor 112 and the power source 118 can be coupled to the body 108 such that the suction motor 112 and the power source 118 can be transitioned/moved (e.g., pivoted) between a wand vacuum position (e.g., as shown in FIG. 1) and a hand vacuum position (e.g., as shown in FIG. 2). When the vacuum assembly 106 is in the wand vacuum configuration, the suction motor 112 and the power source 118 can be in the wand vacuum position and, when the vacuum assembly 106 is in the hand vacuum configuration, the suction motor 112 and the power source 118 can be in the hand vacuum position. Further, when the surface treatment apparatus 100 is in the wand vacuum mode, the vacuum assembly 106 can be in the wand vacuum configuration and, when the surface treatment apparatus 100 is in the hand vacuum mode, the vacuum assembly 106 can be in the hand vacuum configuration.

As shown in FIG. 1, when the vacuum assembly 106 is in the wand vacuum configuration, the dust cup 110, the suction motor 112, and the power source 118 can generally be described as being arranged serially (e.g., aligned along a first axis 122 that generally extends longitudinally relative to the wand 104). As such, when the suction motor 112 and the power source 118 are in the wand vacuum position, the suction motor 112 and the power source 118 extend in a direction along the wand 104, away from the handle 114, and towards the surface treatment head 102. As a result, when transitioning the suction motor 112 and power source 118 from the hand vacuum position to the wand vacuum position, a position of a center of gravity of the vacuum assembly 106 moves in a direction away from the handle 114. This may make cleaning in the wand vacuum mode easier.

As shown in FIG. 2, when the vacuum assembly 106 is in the hand vacuum configuration, the suction motor 112 and the power source 118 can generally be described as being in a parallel arrangement relative to the dust cup 110 (e.g., aligned along a second axis 124 that is spaced apart from the first axis 122 and that may extend generally parallel to the first axis 122 when the suction motor 112 and power source 118 are in the hand vacuum position). As such, when the suction motor 112 and the power source 118 are transitioned to the hand vacuum position, the suction motor 112 and power source 118 move in a direction towards the handle 114. As a result, the center of gravity of the vacuum assembly 106 moves in a direction towards the handle 114 in response to the suction motor 112 and the power source 118 being transitioned from the wand vacuum position to the hand vacuum position. This may make cleaning in the hand vacuum mode easier.

In some instances, the suction motor 112 and the power source 118 may transition between one or more of the hand vacuum position and the wand vacuum position automatically. For example, the suction motor 112 and the power source 118 may transition from the hand vacuum position to the wand vacuum position automatically in response to the vacuum assembly 106 being coupled to the wand 104.

Figure 3:
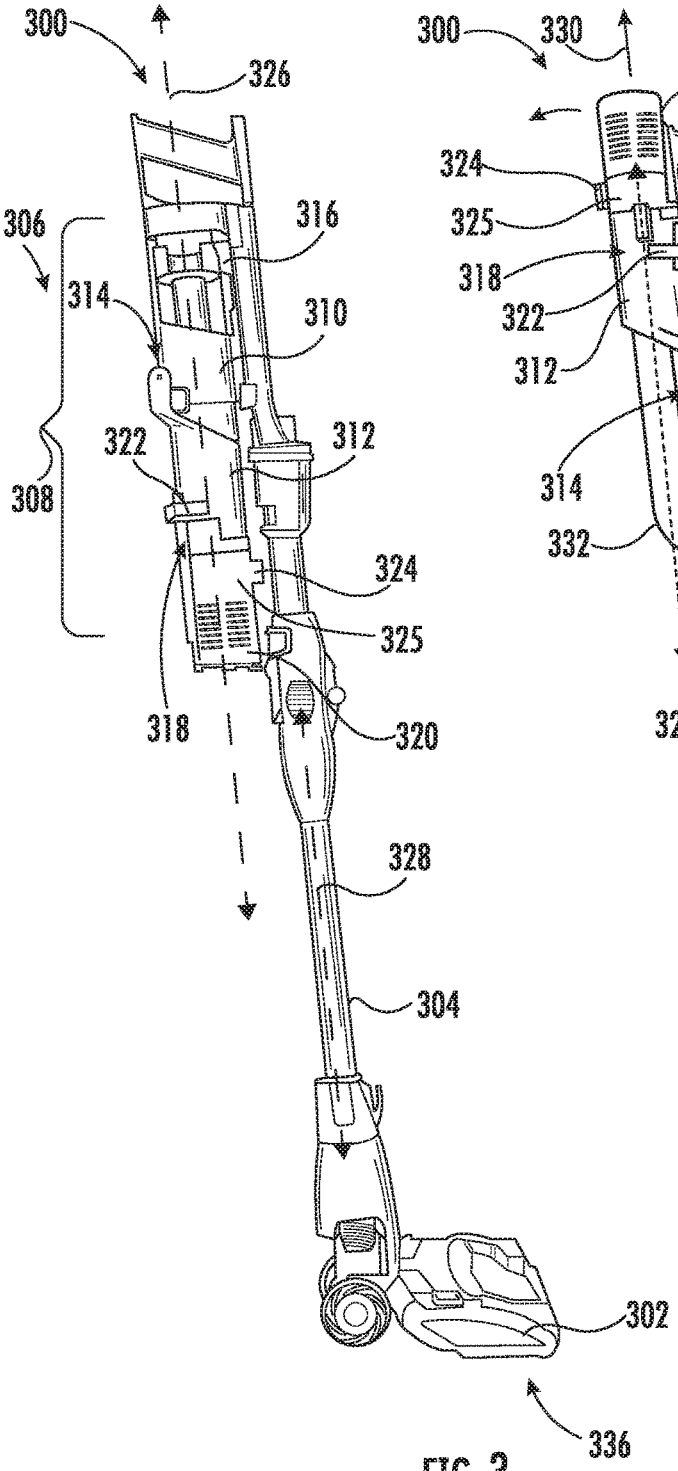
FIG. 3 is a side perspective view of a surface treatment apparatus having a vacuum assembly, wherein a suction motor and a power source of the vacuum assembly are in a wand vacuum position, consistent with embodiments of the present disclosure.
Figure 4:
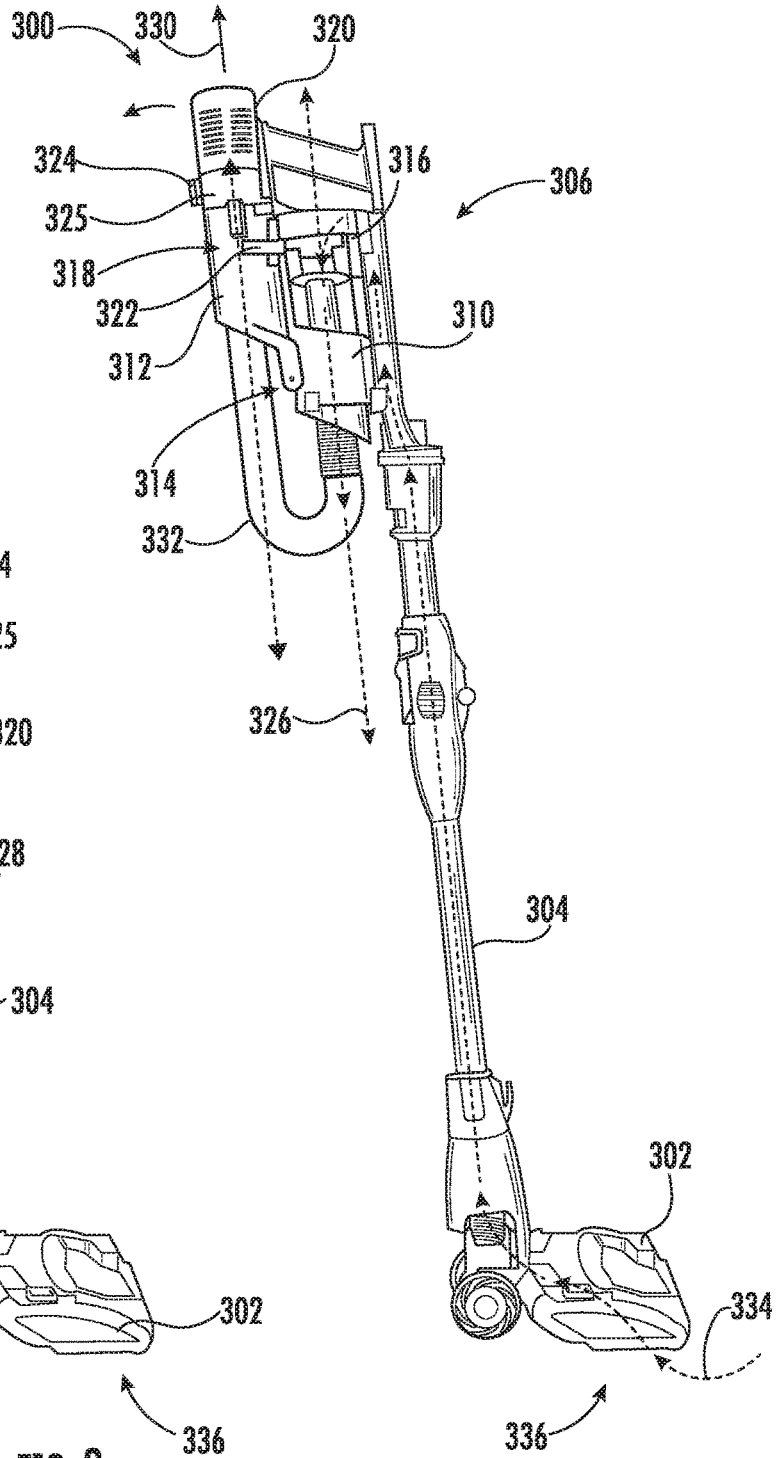
FIG. 4 is another side perspective view of the surface treatment apparatus of FIG. 3, wherein the suction motor and the power source are in a hand vacuum position, consistent with embodiments of the present disclosure.

FIGS. 3 and 4 show perspective side views of a surface treatment apparatus 300, which may be an example of the surface treatment apparatus 100 of FIG. 1. The surface treatment apparatus 300 includes a surface treatment head 302, a wand 304 extending from and coupled to the surface treatment head 302, and a vacuum assembly 306 coupled to the wand 304 such that the vacuum assembly 306 is fluidly coupled to the surface treatment head 302 via an air channel defined within the wand 304. The vacuum assembly 306 is configured to be transitioned between a wand vacuum configuration (e.g., as shown in FIG. 3) and a hand vacuum configuration (e.g., as shown in FIG. 4).

The vacuum assembly 306 includes a body 308 having a first body portion 310 configured to receive the dust cup 316 and a second body portion 312 configured to receive at least one of the suction motor 318 and/or the power source 320. The second body portion 312 is pivotally coupled to the first body portion 310 using a hinged joint 314 such that the second body portion is configured to transition between a wand vacuum position (e.g., as shown in FIG. 3) and a hand vacuum position (e.g., as shown in FIG. 4). The hinged joint 314 may be damped such that rotation of the second body portion 312 relative to the first body portion 310 is controlled. For example, a gasket can be included in the hinged joint 314 to increase frictional resistance to the pivoting of the second body portion 312 relative to the first body portion 310. A dust cup 316 is coupled to the first body portion 310 of the body 308 and a suction motor 318 and a power source 320 (e.g., one or more batteries) are coupled to the second body portion 312 of the body 308. For example, at least a portion of the suction motor 318 and/or the power source 320 can be disposed within a cavity defined by the second body portion 312 of the body 308. As such, when the second body portion 312 is pivoted relative to the first body portion 310, the suction motor 318 and the power source 320 are transitioned between a wand vacuum position (e.g., as shown in FIG. 3) and a hand vacuum position (e.g., as shown in FIG. 4).

As shown, the body 308 includes a latch 322. When the suction motor 318 and power source 320 are in the hand vacuum position, the latch 322 is configured to releasably couple the first body portion 310 of the body 308 to the second body portion 312 of the body 308. For example, the second body portion 312 can include the latch 322 such that, when the suction motor 318 and the power source 320 are in the hand vacuum position, the latch 322 engages at least a portion of the first body portion 310. As also shown, an assembly catch 324 may be provided to releasably couple to, for example, a corresponding assembly latch coupled to the wand 304 such that the second body portion 312 of the body 308 is generally prevented from pivoting relative to the first body portion 310 of the body 308 when the suction motor 318 and the power source 320 are in the wand vacuum position. As shown, the assembly catch 324 may be coupled to a post motor filter housing 325. The post motor filter housing 325 may be integrally formed from or coupled to the second body portion 312 of the body 308. Additionally, or alternatively, one or more detents may be provided (e.g., in the hinged joint 314) such that the one or more detents resist pivotal movement of the second body portion 312 relative to the first body portion 310 when the suction motor 318 and power source 320 are in the wand vacuum position and/or the hand vacuum position.

When in the wand vacuum position, the dust cup 316, the suction motor 318, and the power source 320 may generally be described as being arranged serially. As such, when in the wand vacuum position, the first and second body portions 310 and 312 of the body 308 may generally be described as being arranged serially. When arranged serially, the dust cup 316, the suction motor 318, and the power source 320 may be generally described as being aligned along a first axis 326 that extends generally parallel to a longitudinal axis 328 of at least a portion of the wand 304. For example, the dust cup 316, the suction motor 318, and the power source 320 may be centrally aligned along the first axis 326.

When in the hand vacuum position, the suction motor 318 and the power source 320 may generally be described as being arranged in parallel with the dust cup 316. As such, when in the hand vacuum position, the second body portion 312 may generally be described as being arranged in parallel with the first body portion 310. When arranged in parallel, the suction motor 318 and the power source 320 may be aligned along a second axis 330 that is spaced apart from and extends generally parallel to the first axis 326. For example, the suction motor 318 and the power source 320 may be centrally aligned along the second axis 330 and the dust cup 316 may be centrally aligned along the first axis 326.

As shown in FIG. 4, the vacuum assembly 306 includes a flexible vacuum assembly suction hose 332 configured to extend and retract in response to the suction motor 318 and the power source 320 transitioning between the wand vacuum position and the hand vacuum position. The flexible vacuum assembly suction hose 332 fluidly couples the suction motor 318 to the surface treatment head 302 such that an airflow path 334 extends from a dirty air inlet 336 of the surface treatment head 302 through the wand 304 into the dust cup 316 and through the suction motor 318. As also shown, the airflow path 334 can extend from the suction motor 318 and through the power source 320. As such, the air exhausted from the suction motor 318 can be used to provide cooling to the power source 320. In some instances, the portion of the airflow path 334 that extends through the power source 320 may be adjusted (e.g., using one or more adjustable flaps/vents) to better optimize cooling of the power source 320 based, at least in part, on whether the suction motor 318 and power source 320 are in the hand vacuum position or the wand vacuum position.

Figure 5:
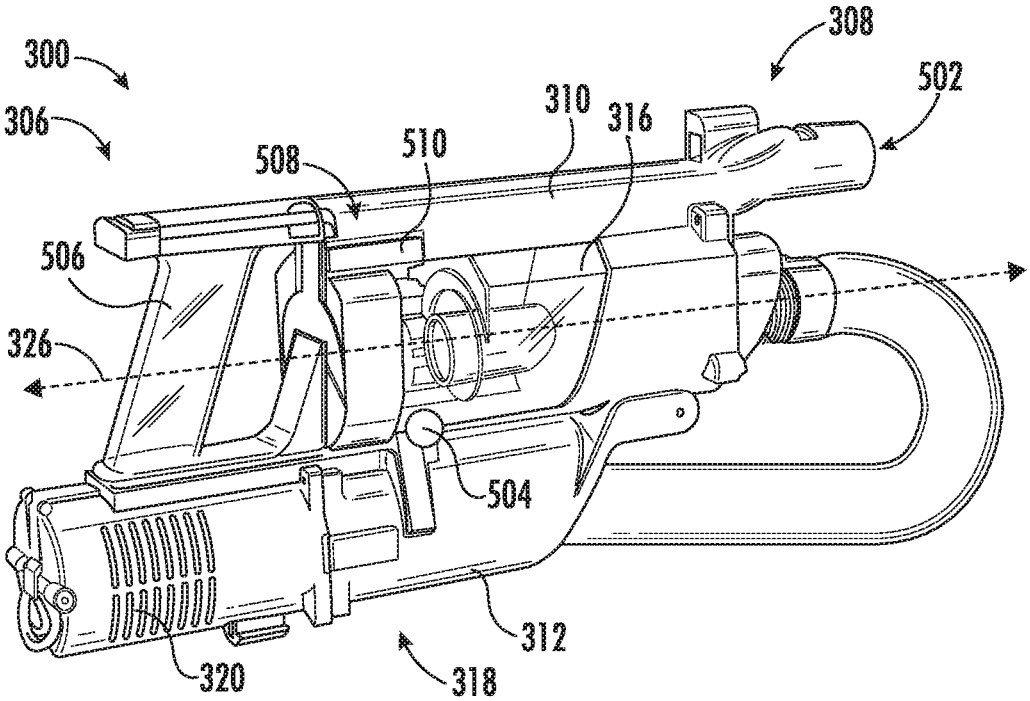
FIG. 5 is a perspective view of the vacuum assembly of FIG. 3, wherein the suction motor and power source are in the hand vacuum position, consistent with embodiments of the present disclosure.

FIG. 5 shows a perspective view of the surface treatment apparatus 300 in the hand vacuum mode. When in the hand vacuum mode, the vacuum assembly 306 is decoupled from one or more of the surface treatment head 302 and/or the wand 304. For example, and as shown, the vacuum assembly 306 is decoupled from the wand 304 and the surface treatment head 302. As such, one or more vacuum accessories (e.g., a crevice tool or brush) may be coupled at a vacuum assembly inlet 502. As also shown, when in the hand vacuum configuration, the suction motor 318 and the power source 320 may be pivoted to the hand vacuum position. Therefore, as the suction motor 318 and the power source 320 pivot towards the hand vacuum position, a center of gravity 504 of the vacuum assembly 306 moves towards a handle 506 of the vacuum assembly 306. Such a configuration may reduce operator fatigue by positioning the center of gravity 504 at a location closer to the operator such that the forces exerted on the operator's wrist may be reduced.

Figure 6:
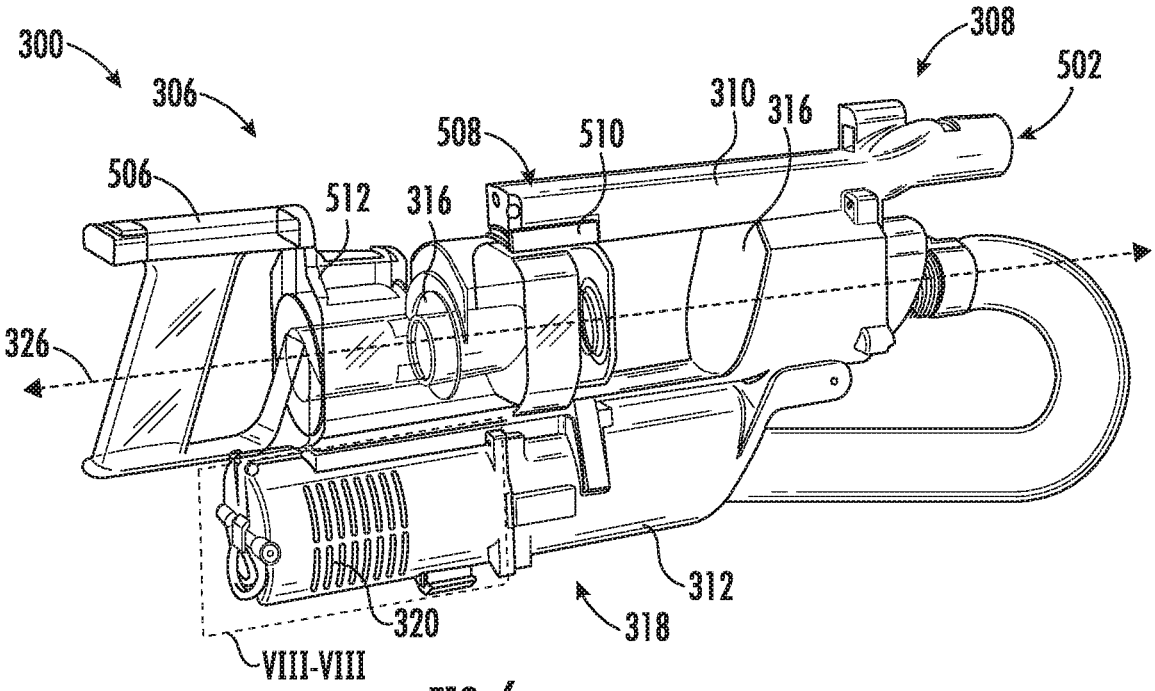
FIG. 6 is another perspective view of the vacuum assembly of FIG. 5, wherein a dust cup of the vacuum assembly is being removed therefrom, consistent with embodiments of the present disclosure.

As shown, the body 308 can include a dust cup release 508 configured to releasably engage the dust cup 316. As such, the dust cup 316 can generally be described as being removably coupled to the body 308. For example, the first body portion 310 of the body 308 can include the dust cup release 508, wherein the dust cup release 508 includes a dust cup release lever 510 pivotally coupled to the first body portion 310 of the body 308. As such, when the dust cup release lever 510 is pivoted, the dust cup release lever 510 disengages a corresponding portion of the dust cup 316 (e.g., a dust cup catch 512) such that the dust cup 316 can be slideably removed from the body 308. For example, as shown in FIG. 6, in response to actuation of the dust cup release 508, the dust cup 316 may be slideably removed from the first body portion 310 of the body 308 in response to a force exerted on the handle 506. As shown, the dust cup 316 is slideably removed from the body 308 in response to movement in a direction generally parallel to the first axis 326. Once removed from the body 308, the dust cup 316 may be emptied and/or cleaned.

Figure 7:
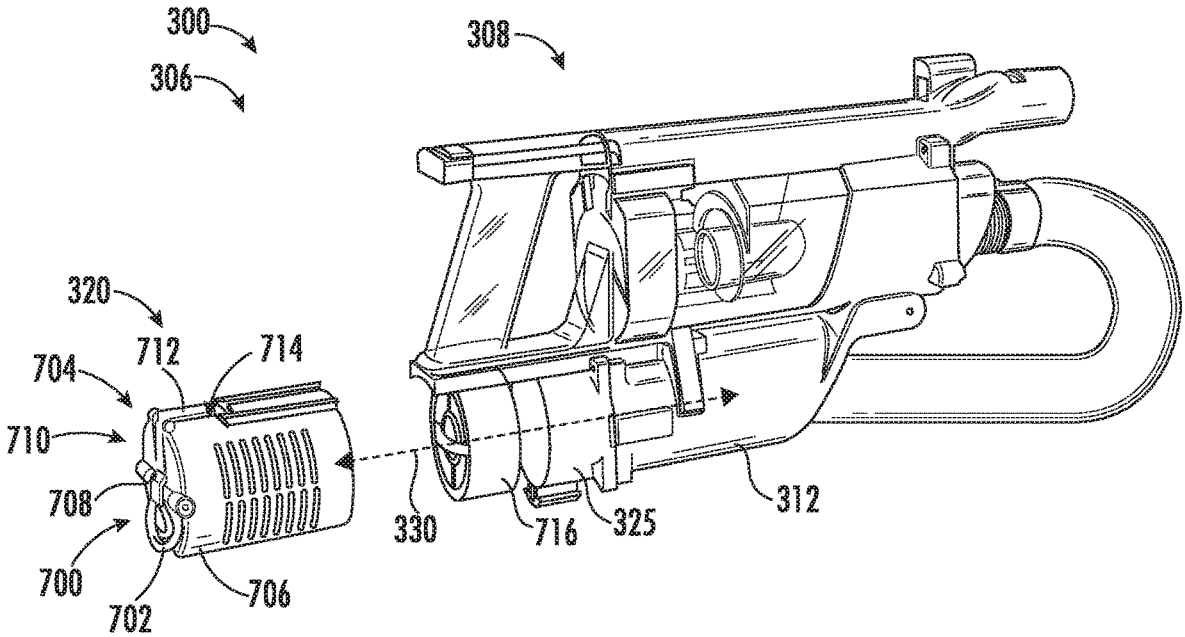
FIG. 7 is another perspective view of the vacuum assembly of FIG. 5, wherein the power source and a post-motor filter are being removed from the vacuum assembly, consistent with embodiments of the present disclosure.

FIG. 7 shows a perspective view of the surface treatment apparatus 300 in the hand vacuum mode. As shown, the power source 320 is removably coupled to the second body portion 312 of the body 308. For example, the power source 320 may be decoupled from the second body portion 312 of the body 308 in response to application of a force on a power source release 700. The power source release 700 may include a graspable actuator 702 and a power source release lever 704 pivotally coupled to a power source housing 706 of the power source 320. The graspable actuator 702 can be pivotally coupled to the power source housing 706 such that in response to being grasped by an operator, the graspable actuator 702 transitions between a locking position and a release position. In response to the pivoting of the graspable actuator 702, the power source release lever 704 pivots between a locking position (e.g., the power source release lever 704 engages a corresponding portion of the second body portion 312) and a release position (e.g., the power source release lever 704 disengages a corresponding portion of the second body 312) such that the power source 320 can be removed from or coupled to the second body portion 312 of the body 308.

As shown, the power source release lever 704 extends along at least two exterior surfaces of the power source housing 706. For example, a first lever portion 708 of the power source release lever 704 can extend along a distal operator facing surface 710 of the power source housing 706 and a second lever portion 712 of the power source release lever 704 can extend along a side surface 714 of the power source housing 706. As shown, the first lever portion 708 of the power source release lever 704 extends generally perpendicular to the second lever portion 712 of the power source release lever 704. As such, in this instance, pivoting the graspable actuator 702 towards the release position causes the second lever portion 712 of the power source release lever 704 to pivot in a direction of the power source housing 706. As a result, this may cause the second lever portion 712 of the power source release lever 704 to at least partially disengage the second body portion 312 of the body 308. As such, the power source 320 can slide relative to the second body portion 312 of the body 308 in a direction generally parallel to the second axis 330.

As also shown, when the power source 320 is decoupled from the second body portion 312 of the body 308, a post motor filter 716 can be removed from the post motor filter housing 325. As such, the post motor filter 716 can be cleaned and/or replaced when the power source 320 is decoupled from the second body portion 312. In some instances, the post motor filter 716 can be a high efficiency particulate air (HEPA) filter.

Figure 8:
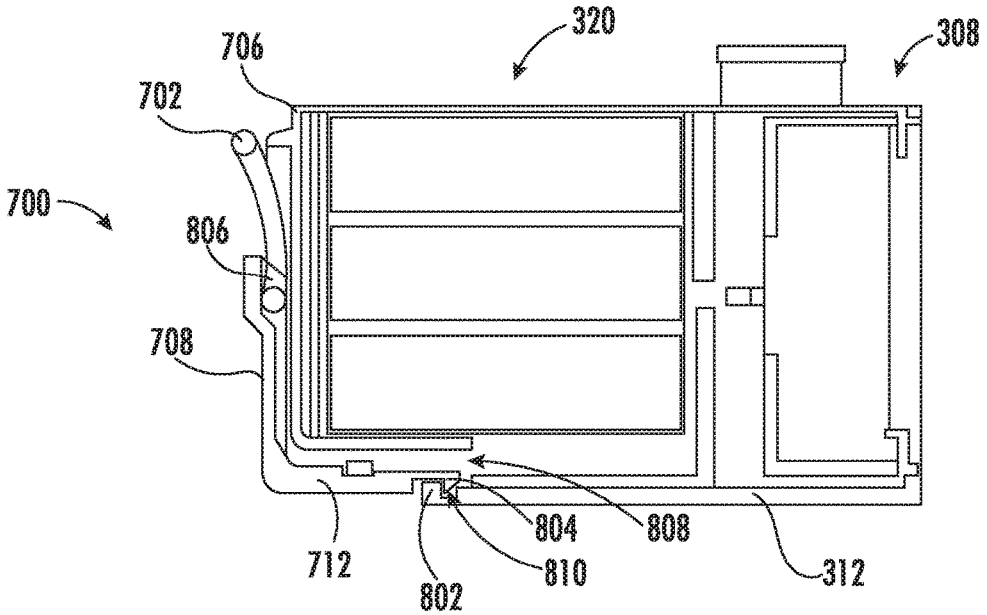
FIG. 8 is a cross-sectional view of a portion of the vacuum assembly of FIG. 6 taken along the plane VIII-VIII, consistent with embodiments of the present disclosure.

FIG. 8 is a cross-sectional view of a portion of the vacuum assembly 306 taken along the plane VIII-VIII of FIG. 6. As shown, the power source release 700 is configured to selectively engage and disengage a power source catch 802 of the second body portion 312 of the body 308. For example, and as shown, the second lever portion 712 of the power source release lever 704 includes a hook 804 configured to engage the power source catch 802. The hook 804 is configured to come out of engagement with the power source catch 802 in response to a pivotal movement of the graspable actuator 702 towards the release position. For example, when the graspable actuator 702 is pivoted, an actuator cam 806, coupled to or formed from the graspable actuator 702, urges the first lever portion 708 of the power source release lever 704 in a direction away from the power source housing 706. As the first lever portion 708 is urged away from the power source housing 706, the second lever portion 712 is urged in a direction of the power source housing 706. As such, the power source housing 706 can define a lever cavity 808 configured to receive at least a portion of the second lever portion 712 when the graspable actuator 702 is pivoted towards the release position. As also shown, the hook 804 may define an inclined surface 810 configured to engage the power source catch 802 when the power source 320 is being recoupled to the second body portion 312 of the body 308. Such a configuration causes the second lever portion 712 to be urged into the lever cavity 808 in response to the power source 320 being recoupled to the second body portion 312 of the body 308. As such, the graspable actuator 702 may not need to be actuated by an operator when the power source 320 is being recoupled to the second body portion 312 of the body 308.

In some instances, a biasing mechanism may be provided that biases the second lever portion 712 in a direction away from the power source housing 706 (e.g., in a direction of the second body portion of the body 308). The biasing mechanism may be a spring (e.g., a compression spring, a tension spring, a torsion spring, and/or any other type of spring), a resiliently deformable material (e.g., a natural or synthetic rubber, a foamed material, and/or any other resiliently deformable material), and/or any other biasing mechanism.

While the power source release 700 is generally described herein as having first and second lever portions 708 and 712 that extend transverse to each other, other configurations are possible. For example, the power source release 700 may include a depressible button that is configured to be depressed linearly. The depressible button may be configured to, for example, actuate a latch in response to being depressed such that the power source 320 can be decoupled from the second body portion 312 of the body 308.

Figure 9:
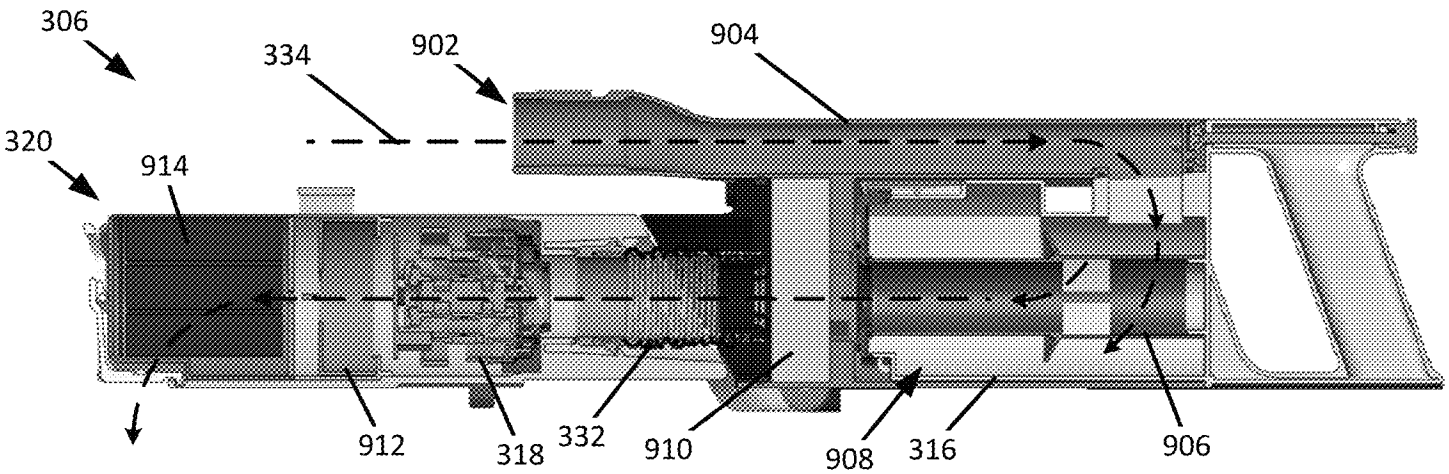
FIG. 9 is a cross-sectional side view of the vacuum assembly of FIG. 3 showing an airflow path when the suction motor and power source are in the wand vacuum position, consistent with embodiments of the present disclosure.

FIG. 9 shows a cross-sectional view of the vacuum assembly 306, wherein the suction motor 318 and the power source 320 are in the wand vacuum position. As shown, the airflow path 334 extends from a vacuum assembly inlet 902 through a vacuum assembly channel 904 and into the dust cup 316. The dust cup 316 can be configured such that the airflow path 334 extends cyclonically around a vortex finder 906. The cyclonic motion of air moving along the airflow path 334 may cause at least a portion of debris entrained within the air to be deposited within a debris containing portion 908 of the dust cup 316. From the dust cup 316, the airflow path 334 may extend through a premotor filter 910, the flexible vacuum assembly suction hose 332, the suction motor 318, a post motor filter 912, and the power source 320. As shown, the power source 320 includes a plurality of batteries 914. Each of the batteries 914 can be cooled using air exhausted from the suction motor 318. Additionally, or alternatively, the power source 320 may be configured to electrically couple to a main power grid (e.g., via a home electrical outlet).

Figure 10:
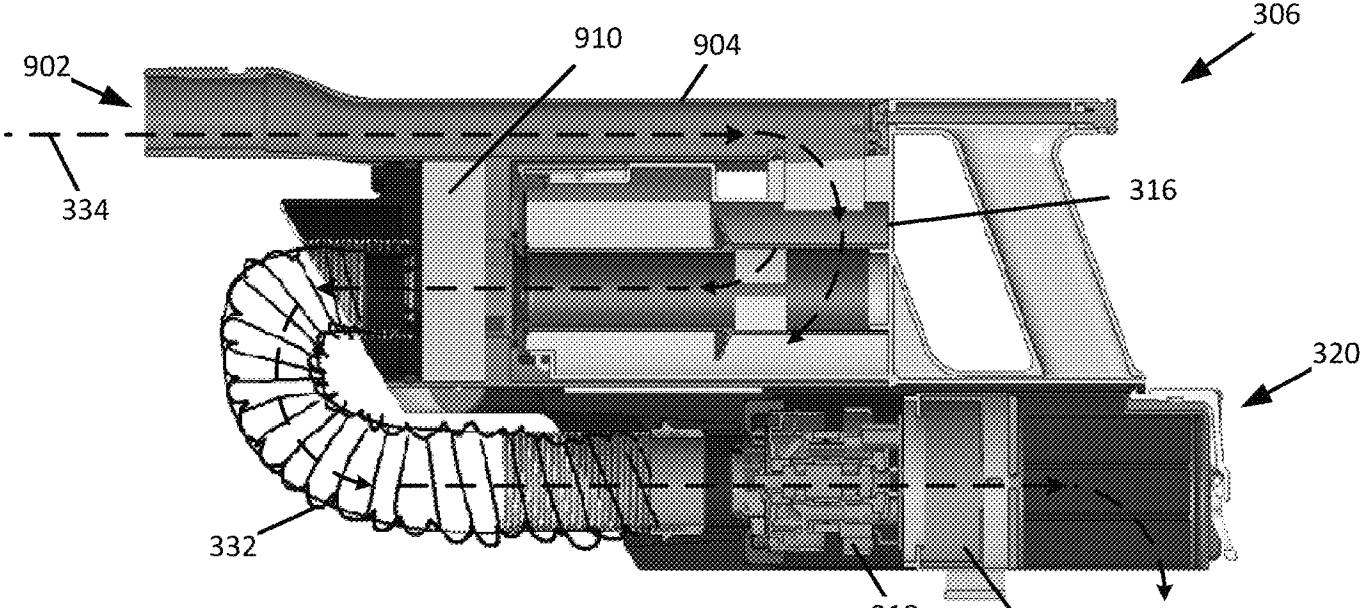
FIG. 10 is a cross-sectional side view of the vacuum assembly of FIG. 3 showing an airflow path when the suction motor and power source are in the hand vacuum position, consistent with embodiments of the present disclosure.

FIG. 10 shows a cross-sectional view of the vacuum assembly 306, wherein the suction motor 318 and the power source 320 are in the hand vacuum position. As shown, the airflow path 334 extends from the vacuum assembly inlet 902 through the vacuum assembly channel 904 and into the dust cup 316. From the dust cup 316, the airflow path 334 extends through the premotor filter 910 and the flexible vacuum assembly suction hose 332, wherein the flexible vacuum assembly suction hose 332 urges air flowing along the airflow path 334 to curve such that the airflow path 334 can extend through the suction motor 318, the post motor filter 912, and the power source 320. For example, the flexible vacuum assembly suction hose 332 may curve approximately (e.g., within 5% of the value) 180° when the suction motor and the power source 320 are in the hand vacuum position. The curve introduced by the flexible vacuum assembly suction hose 332 may reduce the efficiency of the airflow path 334, when the suction motor 318 and power source 320 are in the hand vacuum position, relative to the efficiency of the airflow path 334, when the suction motor 318 and power source 320 are in the wand vacuum position. As such, the suction force may increase and/or the power usage may decrease when the suction motor 318 and power source 320 are in the wand vacuum position when compared to the situation where the suction motor 318 and power source 320 are in the hand vacuum position.

Figure 11:
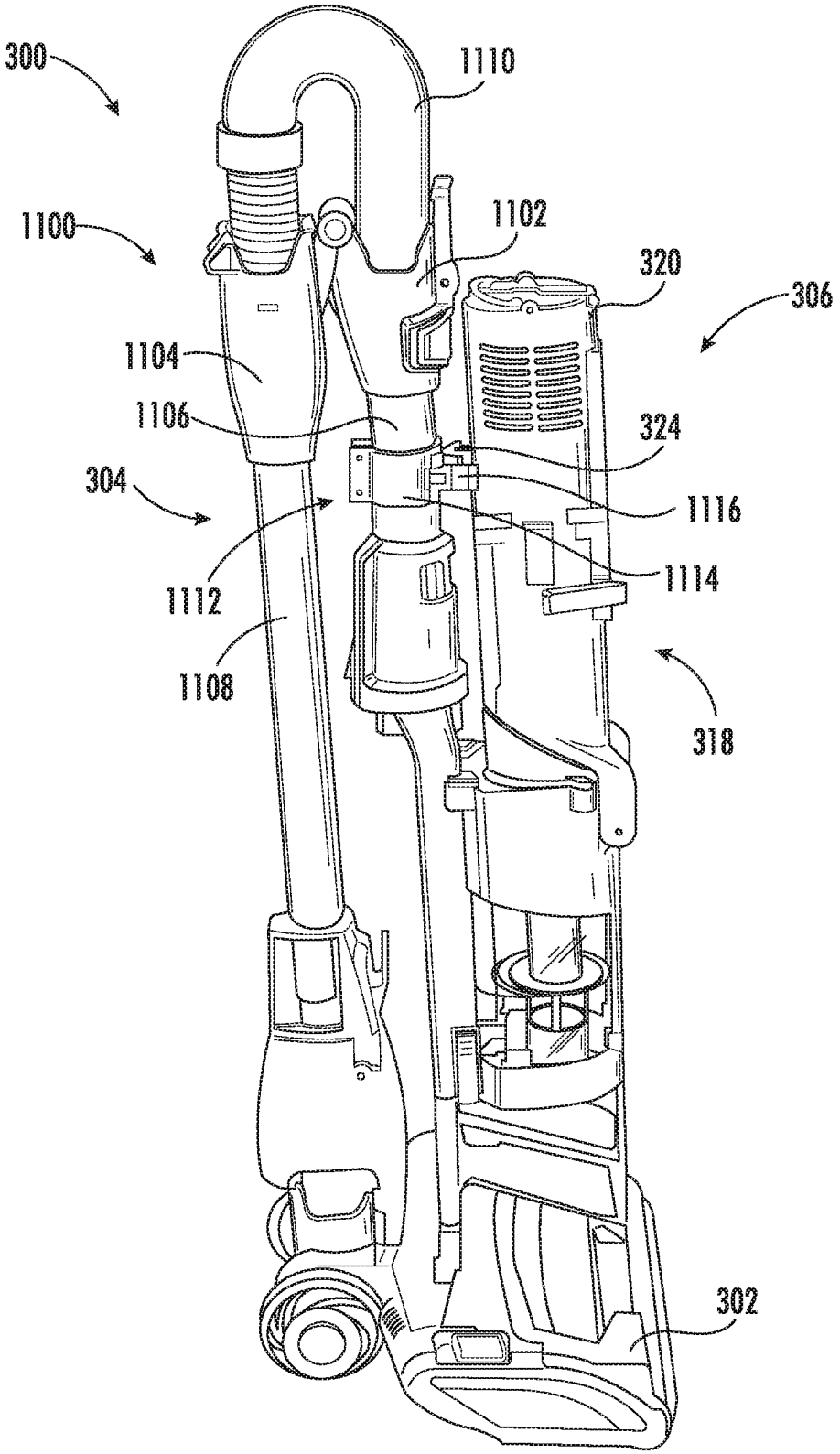
FIG. 11 shows a perspective view of the surface treatment apparatus of FIG. 3 in a storage position, wherein the vacuum assembly is in the wand vacuum position, consistent with embodiments of the present disclosure.

FIG. 11 shows a perspective view of the surface treatment apparatus 300, wherein the wand 304 includes a joint 1100. The joint 1100 includes a first joint body 1102 and a second joint body 1104, the first joint body 1102 being pivotally coupled to the second joint body 1104. The first joint body 1102 is coupled to a first wand segment 1106 and the second joint body 1104 is coupled to a second wand segment 1108. A flexible joint suction hose 1110 fluidly couples the first wand segment 1106 to the second wand segment 1108. As such, when the first joint body 1102 pivots relative to the second joint body 1104 the flexible joint suction hose 1110 extends and retracts while allowing the first and second wand segments 1106 and 1108 to remain fluidly coupled to one another. The pivoting of the first joint body 1102 relative to the second joint body 1104 may allow the surface treatment head 302 to be more easily maneuvered under furniture (e.g., by reducing the amount an operator has to bend over in order to maneuver the surface treatment head 302 under furniture).

In some instances, the first joint body 1102 can pivot approximately (e.g., within 5% of the value) 180° such that the joint 1100 transitions between a storage position and an in-use position. When in the storage position, the vacuum assembly 306 is positioned proximate the surface treatment head 302 when compared to an in-use position (e.g., as shown in FIGS. 3 and 4). In other words, when transitioning to the storage position, the vacuum assembly 306 moves towards the surface treatment head 302. As such, a center of gravity of the surface treatment apparatus 300 may be positioned at a location closer to a surface supporting the surface treatment apparatus (e.g., a floor) when the surface treatment apparatus 300 is in the storage position, which may increase the stability of the surface treatment apparatus 300 when being stored in the storage position.

As shown, when in the storage position, the suction motor 318 and the power source 320 can be in the wand vacuum position. The first wand segment 1106 can include an assembly latch 1112 configured to releasably couple to the assembly catch 324. As shown, the assembly latch 1112 can include a collar 1114 that at least partially extends around the first wand segment 1106 and a plurality of arms 1116 that extend from the collar 1114. The arms 1116 are configured to engage assembly catch 324. The arms 1116 can be pivotally coupled to the collar 1114 such that the arms 1116 are urged apart in response to the assembly catch 324 being urged into engagement with the arms 1116. As such, the arms 1116 may be urged inwardly in a direction towards each other using, for example, a biasing mechanism. The biasing mechanism may be a spring (e.g., a compression spring, a tension spring, a torsion spring, and/or any other type of spring), a resiliently deformable material (e.g., a natural or synthetic rubber, a foamed material, and/or any other resiliently deformable material), and/or any other biasing mechanism.

In some instances, the assembly latch 1112 can be configured to slideably engage the first wand segment 1106 such that the assembly latch 1112 can transition between a release position and a locking position (e.g., in response to movement along the first wand segment 1106 in a longitudinal direction). When in the locking position, the assembly latch 1112 can engage the assembly catch 324 such that the suction motor 318 and the power source 320 are prevented from pivoting from the wand vacuum position to the hand vacuum position.

Additionally, or alternatively, the arms 1116 can be configured to be urged apart by an operator such that the assembly catch 324 can disengage the arms 1116. For example, an actuator (e.g., a button or trigger) may be configured to cause the arms 1116 to be urged apart when actuated.

Figure 12:
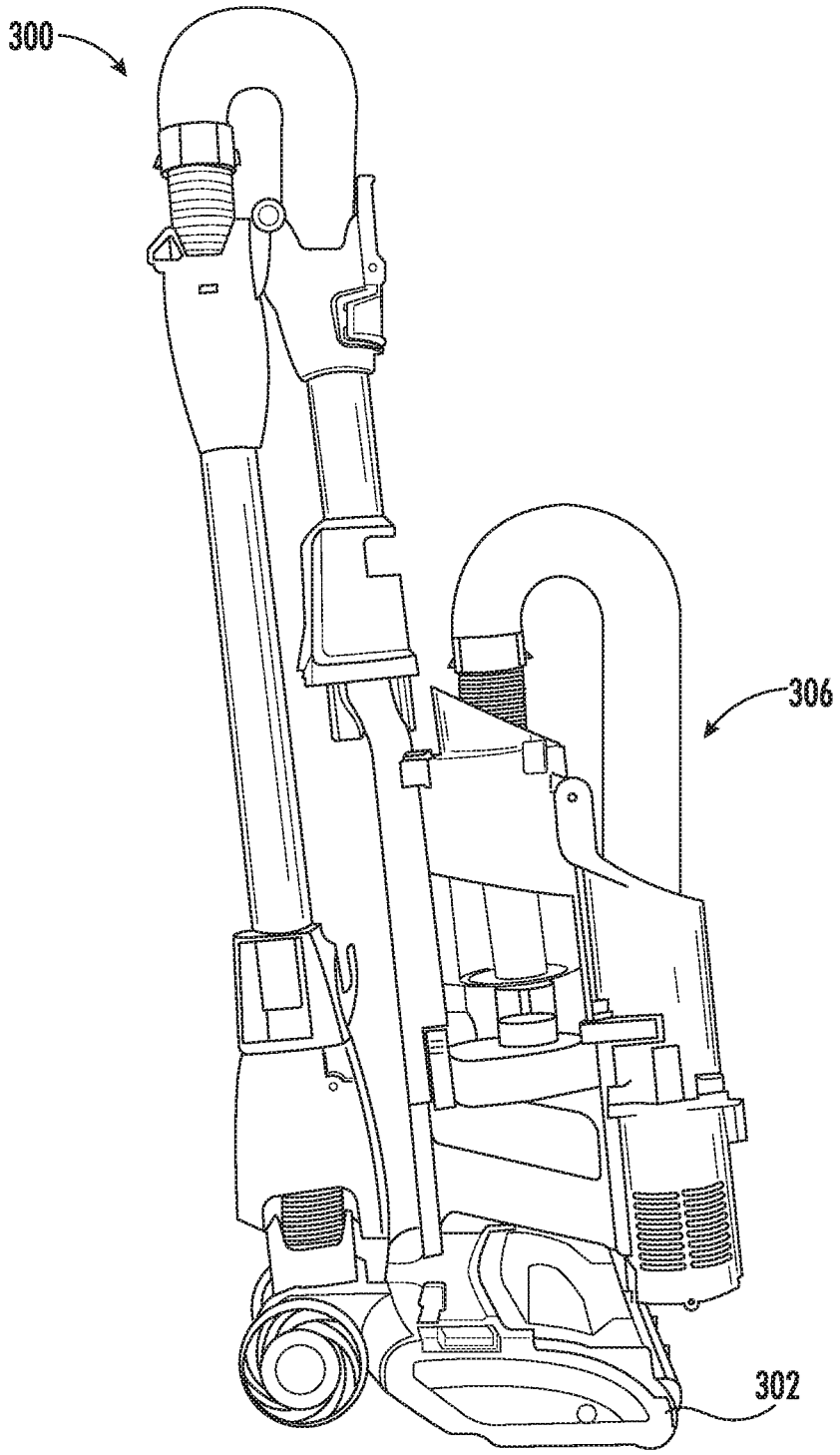
FIG. 12 shows another perspective view of the surface treatment apparatus of FIG. 11 in the storage position, wherein the vacuum assembly is in the hand vacuum position, consistent with embodiments of the present disclosure.

As shown in FIG. 12, when the surface treatment apparatus 300 is in the storage position, the vacuum assembly 306 may be in the hand vacuum position. Such a configuration may position the center gravity of the surface treatment apparatus 300 at a location closer to the surface treatment head 302 when compared to the situation where the vacuum assembly is in the wand vacuum position. As a result, the stability of the surface treatment apparatus 300 may be improved.

Figure 14:
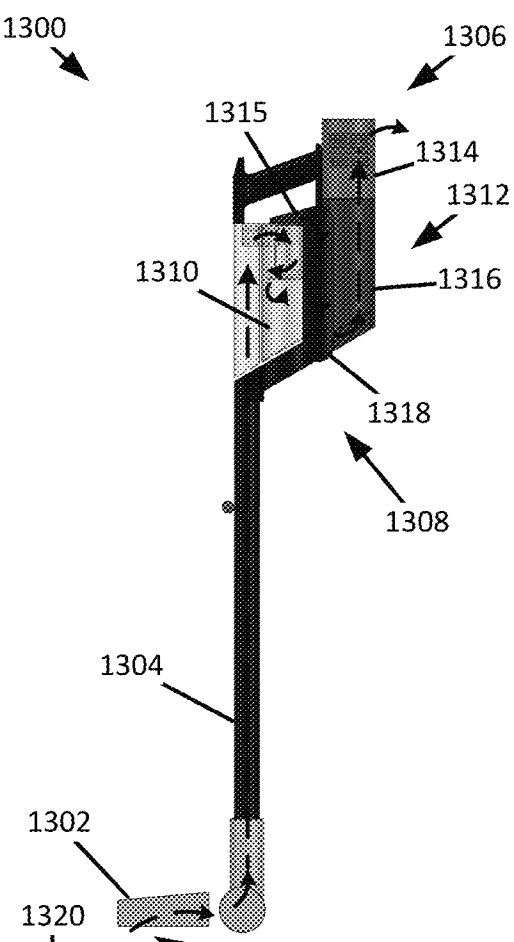
FIG. 14 is another schematic side view of the surface treatment apparatus of FIG. 13, wherein the suction motor and the power source are in a hand vacuum position, consistent with embodiments of the present disclosure.
Figure 13:
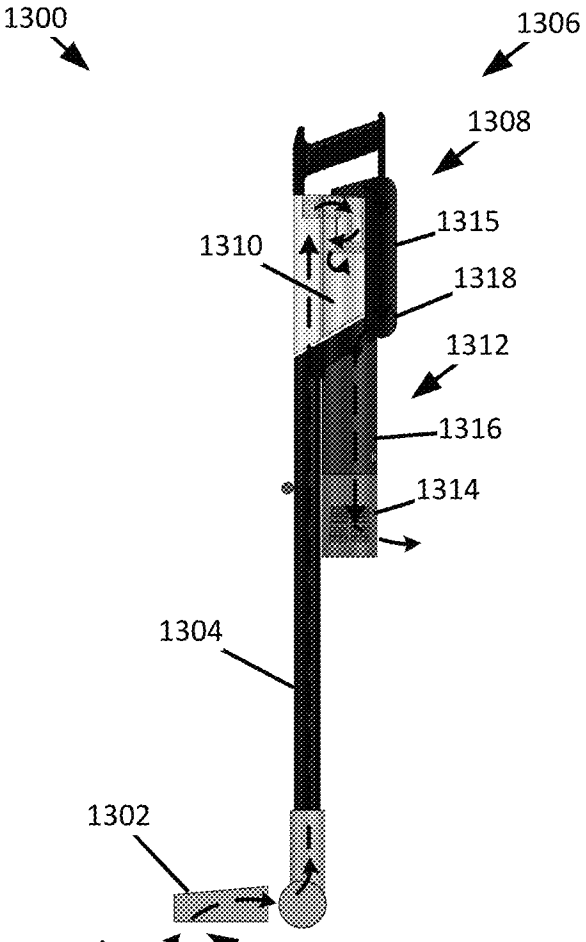
FIG. 13 is a schematic side view of a surface treatment apparatus having a vacuum assembly, wherein a suction motor and a power source of the vacuum assembly are in a wand vacuum position, consistent with embodiments of the present disclosure.

FIGS. 13 and 14 show a schematic example of a surface treatment apparatus 1300, which may be an example of the surface treatment apparatus 100 of FIG. 1. As shown, the surface treatment apparatus 1300 includes a surface treatment head 1302, a wand 1304 coupled to and extending from the surface treatment head 1302, and a vacuum assembly 1306 fluidly coupled to the surface treatment head 1302. The vacuum assembly 1306 is configured to transition between a wand vacuum configuration (e.g., as shown in FIG. 13) and a hand vacuum configuration (e.g., as shown in FIG. 14).

As shown, the vacuum assembly 1306 includes a body 1308, a dust cup 1310, a suction motor 1312, and a power source 1314. The dust cup 1310 can be removably coupled to a first body portion 1315 of the body 1308. The suction motor 1312 can be coupled to a second body portion 1316 of the body 1308 and the power source 1314 can be coupled to the second body portion 1316 of the body 1308. For example, the second body portion 1316 of the body 1308 can define a cavity for receiving at least a portion of the suction motor 1312 and/or the power source 1314.

As also shown, the body 1308 can include a hinged joint 1318 such that the second body portion 1316 can pivot relative to the first body portion 1315. Therefore, the second body portion 1316 can be configured to pivot between a wand vacuum position (e.g., as shown in FIG. 13) and a hand vacuum position (e.g., as shown in FIG. 14). As such, the suction motor 1312 and the power source 1314 can generally be described as being configured to transition between a wand vacuum position (e.g., as shown in FIG. 13) and a hand vacuum position (e.g., as shown in FIG. 14) in response to the pivoting of the second body portion 1316 relative to the first body portion 1315.

The suction motor 1312 is configured to cause an airflow to be generated that extends along an airflow path 1320. As shown, the airflow path 1320 extends from a dirty air inlet 1322 of the surface treatment head 1302 through the wand 1304 and into the dust cup 1310. From the dust cup 1310, the airflow path 1320 extends through the first body portion 1315 of the body 1308, the hinged joint 1318, the second body portion 1316 of the body 1308, the suction motor 1312, and the power source 1314. In other words, the suction motor 1312 is fluidly coupled to the dust cup 1310 via one or more channels defined within the first body portion 1315 of the body 1308, the hinged joint 1318, and the second body portion 1316 of the body 1308.

Figure 15:
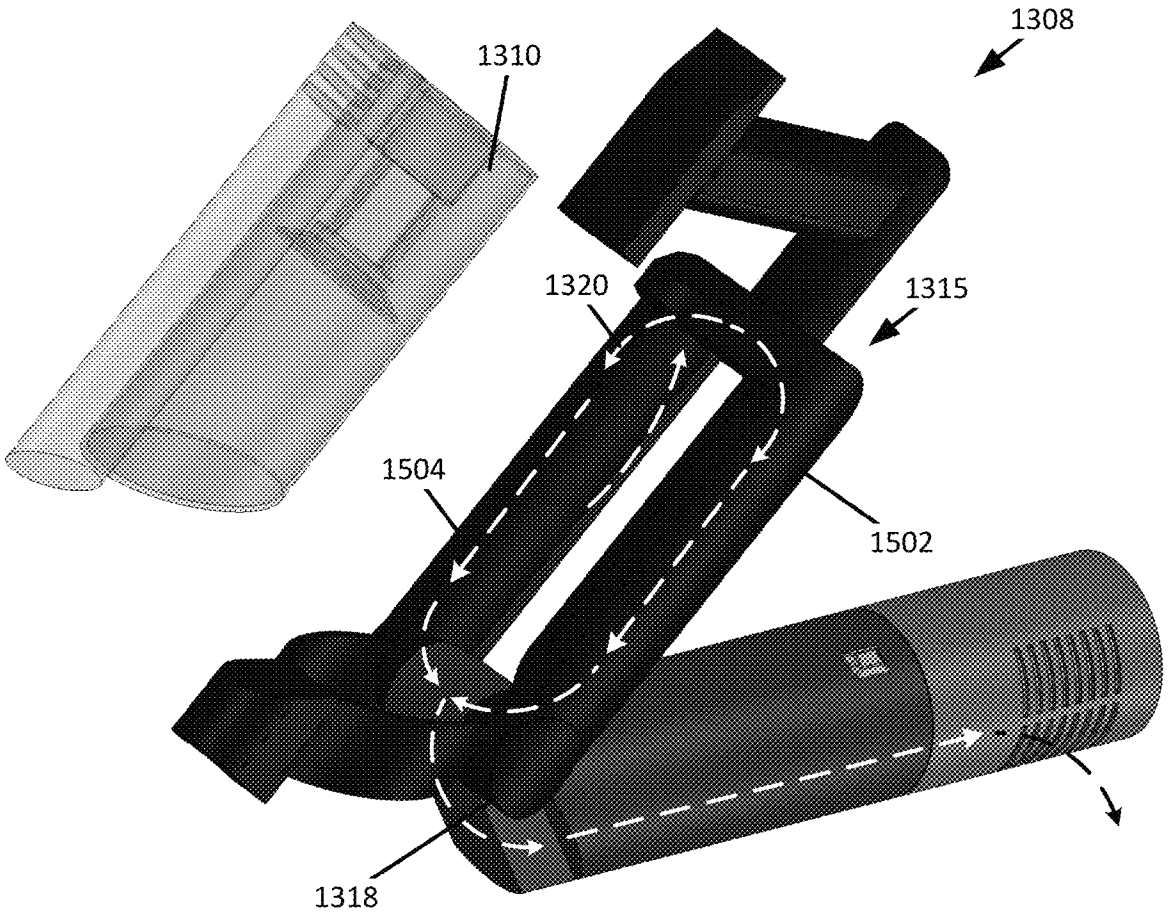
FIG. 15 is a schematic perspective view of the vacuum assembly of FIG. 13, wherein a dust cup of the vacuum assembly is decoupled therefrom, consistent with embodiments of the present disclosure.

FIG. 15 shows a perspective view of the vacuum assembly 1306 with the dust cup 1310 separated therefrom. As shown, the first body portion 1315 of the body 1308 can define a first air channel 1502 and a second air channel 1504 such that at least a portion of air exiting the dust cup 1310 flows along the airflow path 1320 through each air channel 1502 and 1504. The first and second air channels 1502 and 1504 are fluidly coupled to the suction motor 1312 via the hinged joint 1318.

Figure 16:
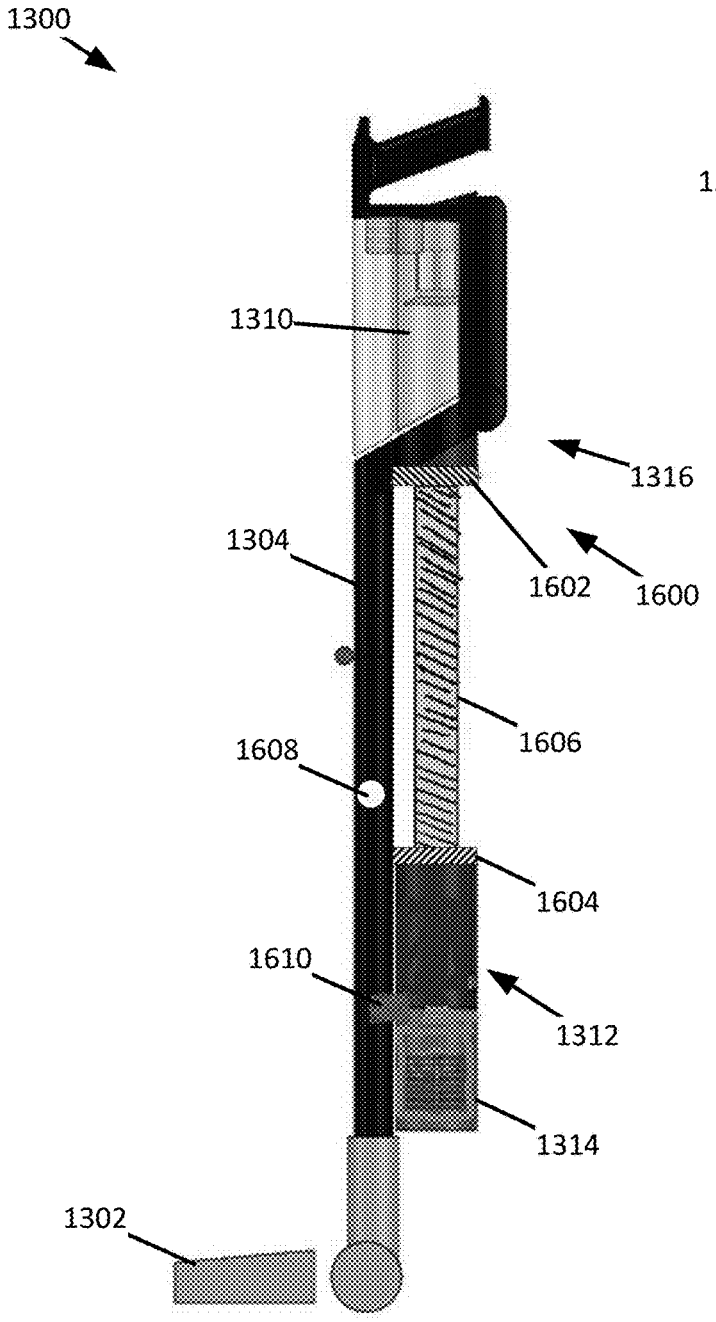
FIG. 16 is a schematic side view of an example of the surface treatment apparatus of FIG. 13, wherein the suction motor and the power source are movable in a direction along a wand of the surface treatment apparatus, consistent with embodiments of the present disclosure.

FIG. 16 shows a schematic side view of an example of the surface treatment apparatus 1300. As shown, the second body portion 1316 can include a coupling 1600 having a first coupling portion 1602 and a second coupling portion 1604, the second coupling portion 1604 being removably coupled to the first coupling portion 1602, wherein at least a portion of a flexible vacuum assembly suction hose 1606 extends between the first and second coupling portions 1602 and 1604. The second coupling portion 1604 is configured to be decoupled from the first coupling portion 1602 such that the flexible vacuum assembly suction hose 1606 can extend along at least a portion of the wand 1304 in response to the second coupling portion 1604 being decoupled from the first coupling portion 1602. The suction motor 1312 and the power source 1314 can be coupled to the second coupling portion 1604 such that the suction motor 1312 and the power source 1314 can be moved along the wand 1304 with the second coupling portion 1604.

The flexible vacuum assembly suction hose 1606 fluidly couples the suction motor 1312 to the dust cup 1310 such that the suction motor 1312 and the power source 1314 can be moved along the wand 1304 in a direction towards the surface treatment head 1302. As such, the suction motor 1312 and the power source 1314 can be positioned proximate the surface treatment head 1302. For example, the second coupling portion 1604 may be disposed between the surface treatment head 1302 and a midpoint 1608 of the wand 1304. As a result, a center of gravity of the surface treatment apparatus 1300 moves in a direction of the surface treatment head 1302 as the suction motor 1312 and power source 1314 are moved towards the surface treatment head 1302.

As shown, a retaining catch 1610 couples the suction motor 1312 and the power source 1314 to the wand 1304 at a position proximate the surface treatment head 1302. For example, the retaining catch 1610 may be coupled to the wand 1304 and may be configured to engage at least a portion of one or more of the second body portion 1316 and/or the power source 1314.

In some instances, at least a portion of the second body portion 1316 (e.g., the portion having the suction motor 1312) and/or the power source 1314 may be decoupled from the second coupling portion 1604. For example, the power source 1314 can be replaced with an alternate power source configured to provide more electrical power (e.g., when the power source 1314 includes one or more batteries, the alternate power source may not include one or more batteries and, instead, may be configured to be coupled to an electrical power grid via an electrical outlet). By way of further example, the suction motor 1312 can be replaced with an alternate suction motor configured to provide more suction power. By way of still further example, the suction motor 1312 and the power source 1314 may be replaced simultaneously as a single unit. As such, the power source 1314 can be optimized for the suction motor 1312 being used.

Figure 17A:
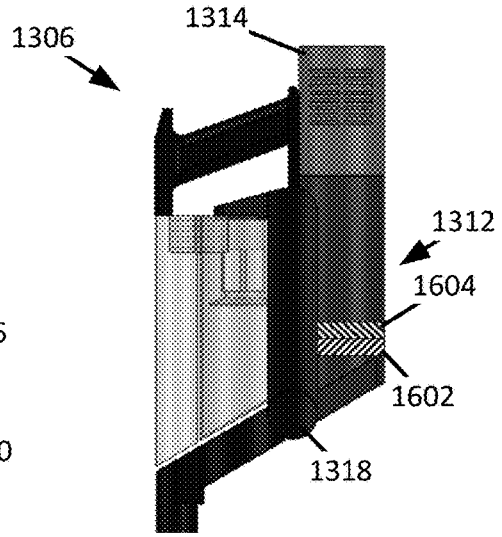
FIG. 17A is a schematic side view of an example of the vacuum assembly of the surface treatment apparatus of FIG. 16, consistent with embodiments of the present disclosure.

FIG. 17A shows an example of the vacuum assembly 1306 having the suction motor 1312 and power source 1314 in the hand vacuum position. As shown, when the suction motor 1312 and power source 1314 are in the hand vacuum position, the first coupling portion 1602 is coupled to the second coupling portion 1604 such that the flexible vacuum assembly suction hose 1606 is collapsed at least partially between the first and second coupling portions 1602 and 1604. In other words, the flexible vacuum assembly suction hose 1606 may generally be described as having a storage configuration (e.g., as shown in FIG. 17A) and an extended configuration (e.g., as shown in FIG. 16). In some instances, the flexible vacuum assembly hose 1606 may extend at least partially within the hinged joint 1318.

Figure 17B:
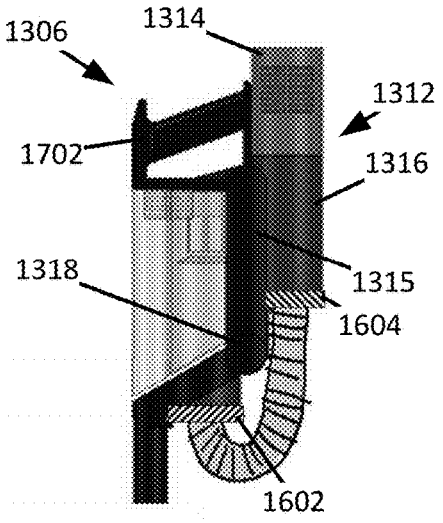
FIG. 17B is another schematic side view of an example of the vacuum assembly of the surface treatment apparatus of FIG. 16, consistent with embodiments of the present disclosure.

FIG. 17B shows another example of the vacuum assembly 1306 having the suction motor 1312 and the power source 1314 in the hand vacuum position. As shown, when the suction motor 1312 and the power source 1314 are in the hand vacuum position, the flexible vacuum assembly hose 1606 remains at least partially extended such that at least a portion of the flexible vacuum assembly hose 1606 extends in a direction of a handle 1702 of the vacuum assembly 1306 (e.g., the flexible vacuum assembly hose 1606 includes a curved portion). As such, when the suction motor 1312 and the power source 1314 are in the hand vacuum position, the second coupling portion 1604 may be decoupled from the first coupling portion 1602. Such a configuration, may allow the hinged joint 1318 to be omitted such that the second body portion 1316 is not pivotally coupled to the first body portion 1315.

The first and second coupling portions 1602 and 1604 may be coupled to each other using, for example, one or more magnets, a friction fit, one or more releasable snap fits, one or more bayonet fittings, thread fits, and/or any other form of coupling.

Figure 19:
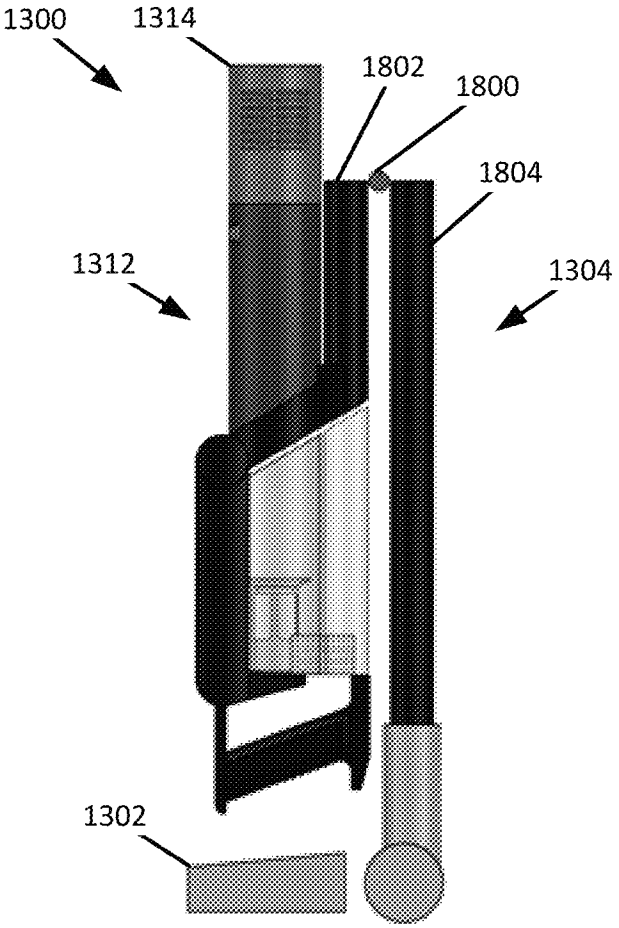
FIG. 19 is another schematic side view of the surface treatment apparatus of FIG. 18, wherein the joint is in the storage position and the suction motor and the power source are in the wand vacuum position, consistent with embodiments of the present disclosure.
Figure 18:
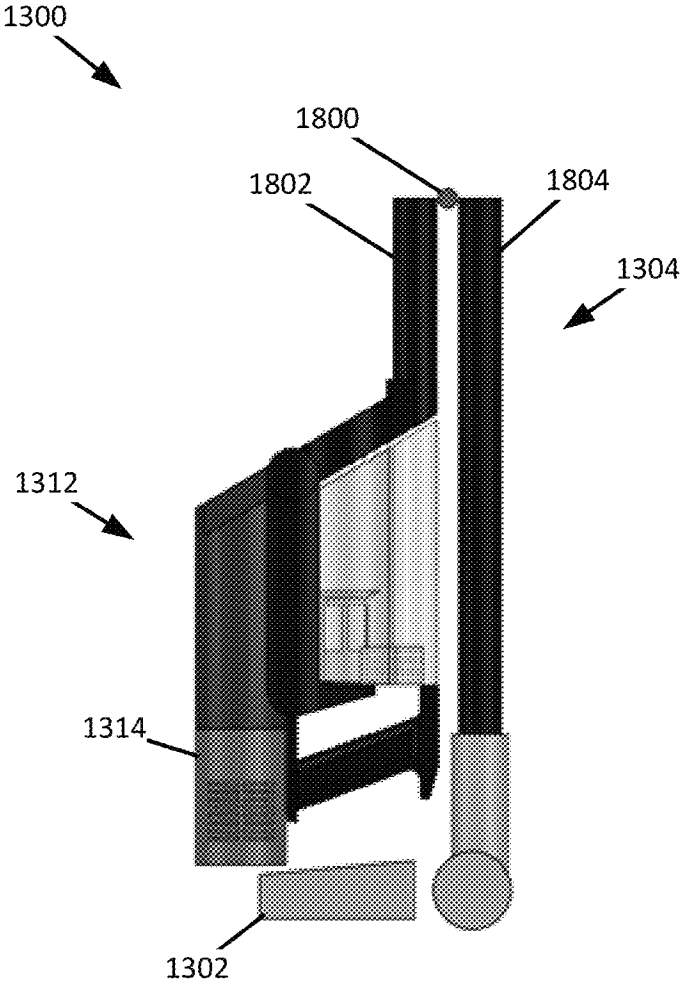
FIG. 18 is a schematic side view of an example of the surface treatment apparatus of FIG. 13 having a wand with a joint transitionable between an in-use and a storage position, wherein the joint is in the storage position and the suction motor and the power source are in the hand vacuum position, consistent with embodiments of the present disclosure.

As shown in FIGS. 18 and 19, the wand 1304 includes a joint 1800 configured such that a first wand segment 1802 can pivot relative to a second wand segment 1804. For example, the joint 1800 can be configured to allow the first wand segment 1802 to pivot substantially (e.g., within 5% of the value) 180° in a direction of the surface treatment head 1302 such that the surface treatment apparatus 1300 transitions between an in-use position (e.g., as shown in FIGS. 13 and 14) to a storage position (e.g., as shown in FIGS. 18 and 19). In some instances, the joint 1800 can be configured to allow the first wand segment 1802 to pivot relative to the second wand segment 1804 in-use. In these instances, it may allow the surface treatment had 1302 to be maneuvered under furniture while reducing an amount an operator is required to bend over in order to maneuver the surface treatment head 1302 under furniture. As also shown, when the surface treatment apparatus 1300 is in the storage position the suction motor 1312 and the power source 1314 may be in either a hand vacuum position (e.g., as shown in FIG. 18) or a wand vacuum position (e.g., as shown in FIG. 19). In some instances, the position of the suction motor 1312 and the power source 1314 may cause, for example, one or more charging contacts and/or charge indicators to be exposed.

An example of a vacuum assembly having a hand vacuum configuration and a wand vacuum may include a dust cup, a suction motor, and a power source. The suction motor may be fluidly coupled to the dust cup. The suction motor and the power source may be transitionable between a wand vacuum position and a hand vacuum position. When the suction motor and the power source are in the wand vacuum position, the dust cup, the suction motor, and the power source may be arranged serially. When the suction motor and the power source are in the hand vacuum position, the suction motor and the power source may be arranged in parallel with the dust cup.

In some instances, the vacuum assembly may include a body having a first body portion and a second body portion. The second body portion may be pivotally coupled to the first body portion, wherein the dust cup may be coupled to the first body portion and the suction motor and the power source may be coupled to the second body portion. In some instances, the power source is removably coupled to the second body portion. In some instances, the power source may include a power source release having a graspable actuator configured to cause a power source release lever to pivot in response to being actuated such that the power source release lever disengages a corresponding portion of the second body portion. In some instances, the vacuum assembly may include a flexible suction hose configured to fluidly couple the suction motor to the dust cup. In some instances, the flexible suction hose extends in response to the power source and the suction motor being transitioned to the hand vacuum position.

An example of a surface treatment apparatus may include a surface treatment head, a wand, and a vacuum assembly. The wand may extend from and be coupled to the surface treatment head. The vacuum assembly may be coupled to the wand such that the vacuum assembly is fluidly coupled to the surface treatment head. The vacuum assembly may include a dust cup, a suction motor, and a power source. The suction motor may be fluidly coupled to the dust cup. The suction motor and the power source may be transitionable between a wand vacuum position and a hand vacuum position. When the suction motor and the power source are in the wand vacuum position, the dust cup, the suction motor, and the power source may be arranged serially. When the suction motor and the power source are in the hand vacuum position, the suction motor and the power source may be arranged in parallel with the dust cup.

In some instances, the wand may include a joint having a first joint body and a second joint body. The first joint body may be pivotally coupled to the second joint body. In some instances, the joint is configured to transition between an in-use position and a storage position in response to the pivoting of the first joint body relative to the second joint body. In some instances, when the joint transitions to the storage position, the vacuum assembly moves in a direction towards the surface treatment head. In some instances, the vacuum assembly may include a body having a first body portion and a second body portion. The second body portion may be pivotally coupled to the first body portion, wherein the dust cup may be coupled to the first body portion and the suction motor and the power source may be coupled to the second body portion. In some instances, the power source may be removably coupled to the second body portion. In some instances, the power source may include a power source release having a graspable actuator configured to cause a power source release lever to pivot in response to being actuated such that the power source release lever disengages a corresponding portion of the second body portion. In some instances, the second body portion may include a coupling having a first coupling portion coupled to a second coupling portion. In some instances, the vacuum assembly may include a flexible suction hose that extends at least partially between the first coupling portion and the second coupling portion. The flexible suction hose may be configured to extend in a direction along the wand in response to the second coupling portion being decoupled from the first coupling portion. In some instances, the vacuum assembly may include a flexible suction hose configured to fluidly couple the suction motor to the dust cup. In some instances, the flexible suction hose may extend in response to the power source and the suction motor being transitioned to the hand vacuum position.

An example of a vacuum assembly of a surface treatment apparatus may include a first body portion and a second body portion. The body portion may be configured to receive a dust cup. The second body portion may be pivotally coupled to the first body portion such that the second body portion is configured to transition between a wand vacuum position and a hand vacuum position. The second body portion may also be configured to receive at least one of a suction motor or a power source.

In some instances, the first and second body portions may be configured such that, when the second body portion is in the wand vacuum position, the first and second body portions are arranged serially. In some instances, the first and second body portions may be configured such that, when the second body portion is in the hand vacuum position, the second body portion is arranged in parallel with the first body portion.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A vacuum assembly having a hand vacuum configuration and a wand vacuum configuration comprising:

a dust cup;

a suction motor fluidly coupled to the dust cup; and a power source, the suction motor and the power source being configured to pivot relative to the dust cup such that the suction motor and the power source are transitionable between a wand vacuum position and a hand vacuum position, wherein:

when the suction motor and the power source are in the wand vacuum position, the dust cup, the suction motor, and the power source are arranged along a first axis; and when the suction motor and the power source are in the hand vacuum position, the suction motor and the power source are arranged along a second axis that is spaced apart from the first axis and generally parallel to the first axis.

2. The vacuum assembly of claim 1 further comprising a body having a first body portion and a second body portion, the second body portion being pivotally coupled to the first body portion, wherein the dust cup is coupled to the first body portion and the suction motor and the power source are coupled to the second body portion.

3. The vacuum assembly of claim 2, wherein the power source is removably coupled to the second body portion.

4. The vacuum assembly of claim 3, wherein the power source further comprises a power source release having a graspable actuator configured to cause a power source release lever to pivot in response to being actuated such that the power source release lever disengages a corresponding portion of the second body portion.

5. The vacuum assembly of claim 1 further comprising a flexible suction hose configured to fluidly couple the suction motor to the dust cup.

6. The vacuum assembly of claim 5, wherein the flexible suction hose extends in response to the power source and the suction motor being transitioned to the hand vacuum position.

7. A surface treatment apparatus comprising:

a surface treatment head;

a wand extending from and coupled to the surface treatment head; and a vacuum assembly coupled to the wand such that the vacuum assembly is fluidly coupled to the surface treatment head, the vacuum assembly including:

a dust cup;

a suction motor fluidly coupled to the dust cup; and a power source, the suction motor and the power source being configured to pivot relative to the dust cup such that the suction motor and the power source are transitionable between a wand vacuum position and a hand vacuum position, wherein:

when the suction motor and the power source are in the wand vacuum position, the dust cup, the suction motor, and the power source are arranged along a first axis; and when the suction motor and the power source are in the hand vacuum position, the suction motor and the power source are arranged along a second axis that is spaced apart from the first axis and generally parallel to the first axis.

8. The surface treatment apparatus of claim 7, wherein the wand includes a joint having a first joint body and a second joint body, the first joint body being pivotally coupled to the second joint body.

9. The surface treatment apparatus of claim 8, wherein the joint is configured to transition between an in-use position and a storage position in response to the pivoting of the first joint body relative to the second joint body.

10. The surface treatment apparatus of claim 9, wherein when the joint transitions to the storage position, the vacuum assembly moves in a direction towards the surface treatment head.

11. The surface treatment apparatus of claim 7, wherein the vacuum assembly further comprises a body having a first body portion and a second body portion, the second body portion being pivotally coupled to the first body portion, wherein the dust cup is coupled to the first body portion and the suction motor and the power source are coupled to the second body portion.

12. The surface treatment apparatus of claim 11, wherein the power source is removably coupled to the second body portion.

13. The surface treatment apparatus of claim 12, wherein the power source further comprises a power source release having a graspable actuator configured to cause a power source release lever to pivot in response to being actuated such that the power source release lever disengages a corresponding portion of the second body portion.

14. The surface treatment apparatus of claim 11, wherein the second body portion includes a coupling having a first coupling portion coupled to a second coupling portion.

15. The surface treatment apparatus of claim 14, wherein the vacuum assembly further comprises a flexible suction hose that extends at least partially between the first coupling portion and the second coupling portion, the flexible suction hose being configured to extend in a direction along the wand in response to the second coupling portion being decoupled from the first coupling portion.

16. The surface treatment apparatus of claim 7, wherein the vacuum assembly further comprises a flexible suction hose configured to fluidly couple the suction motor to the dust cup.

17. The surface treatment apparatus of claim 16, wherein the flexible suction hose extends in response to the power source and the suction motor being transitioned to the hand vacuum position.

18. A vacuum assembly of a surface treatment apparatus comprising:

a first body portion, the first body portion being configured to receive a dust cup; and a second body portion pivotally coupled to the first body portion such that the second body portion is configured to transition between a wand vacuum position and a hand vacuum position, the second body portion being further configured to receive at least one of a suction motor or a power source, wherein:

when in the wand vacuum position, the first body portion and the second body portion are arranged along a first axis; and when in the hand vacuum position, the second body portion is arranged along a second axis that is spaced apart from the first axis and generally parallel to the first axis.

* * * * *